United States Patent [19]

Friedman

[11] Patent Number: 4,982,846

[45] Date of Patent: Jan. 8, 1991

[54] SIFT-PROOF CARTON AND BLANK THEREFOR

[75] Inventor: Herbert Friedman, Fort Lee, N.J.

[73] Assignee: Ivy Hill Corporation, New York, N.Y.

[21] Appl. No.: 482,078

[22] Filed: Feb. 16, 1990

Related U.S. Application Data

[62] Division of Ser. No. 344,972, Apr. 27, 1989, Pat. No. 4,941,575.

[51] Int. Cl.[5] ..... B65D 5/70

[52] U.S. Cl. ..... 206/621.3; 206/621; 206/626; 229/125.42

[58] Field of Search ..... 229/125.42; 206/621.3, 206/621.5, 621.6, 621, 626

[56] References Cited

U.S. PATENT DOCUMENTS

| | | | |
|---|---|---|---|
| 1,956,238 | 4/1934 | Jackson . | |
| 2,583,856 | 1/1952 | Klein | 206/626 |
| 2,617,581 | 11/1952 | Smith | 229/125.42 |
| 3,095,135 | 6/1963 | Hennessey | 229/125.42 |
| 3,096,011 | 7/1963 | Davis . | |
| 3,155,306 | 11/1964 | Moore . | |
| 3,372,853 | 3/1968 | Rumberger | 206/626 |
| 3,426,955 | 2/1969 | Olson | 206/626 |
| 3,477,632 | 11/1969 | Donahue | 206/621.5 |
| 3,481,524 | 12/1969 | Ruud et al. | 229/125.42 |
| 4,258,876 | 3/1981 | Ljungcrantz . | |
| 4,317,518 | 3/1982 | Mode . | |
| 4,548,318 | 10/1985 | Boyle . | |
| 4,613,046 | 9/1986 | Kuchenbecker . | |
| 4,650,078 | 3/1987 | Desmond et al. . | |
| 4,718,557 | 1/1988 | Friedman . | |
| 4,784,272 | 11/1988 | Cisiecki et al. | 229/125.42 |
| 4,941,565 | 7/1990 | Friedman | 206/621 |

FOREIGN PATENT DOCUMENTS

| | | | |
|---|---|---|---|
| 3717805 | 12/1988 | Fed. Rep. of Germany | 228/125.42 |

*Primary Examiner*—Gary E. Elkins

*Attorney, Agent, or Firm*—Amster, Rothstein & Ebenstein

[57] ABSTRACT

A sift-proof carton which precludes small particulate matter from within the carton escaping to the exterior of the carton includes an exterior major end panel having a length in excess of the major side panel from which it extends, with the excess length being at least partially compacted and folded against the exterior major end panel by a exterior minor end panel where the exterior minor end panel extends partially over the major end panels, thereby providing sift-resistance. The exterior minor end panel preferably has a width less than that of the carton.

39 Claims, 8 Drawing Sheets

FIG. 1
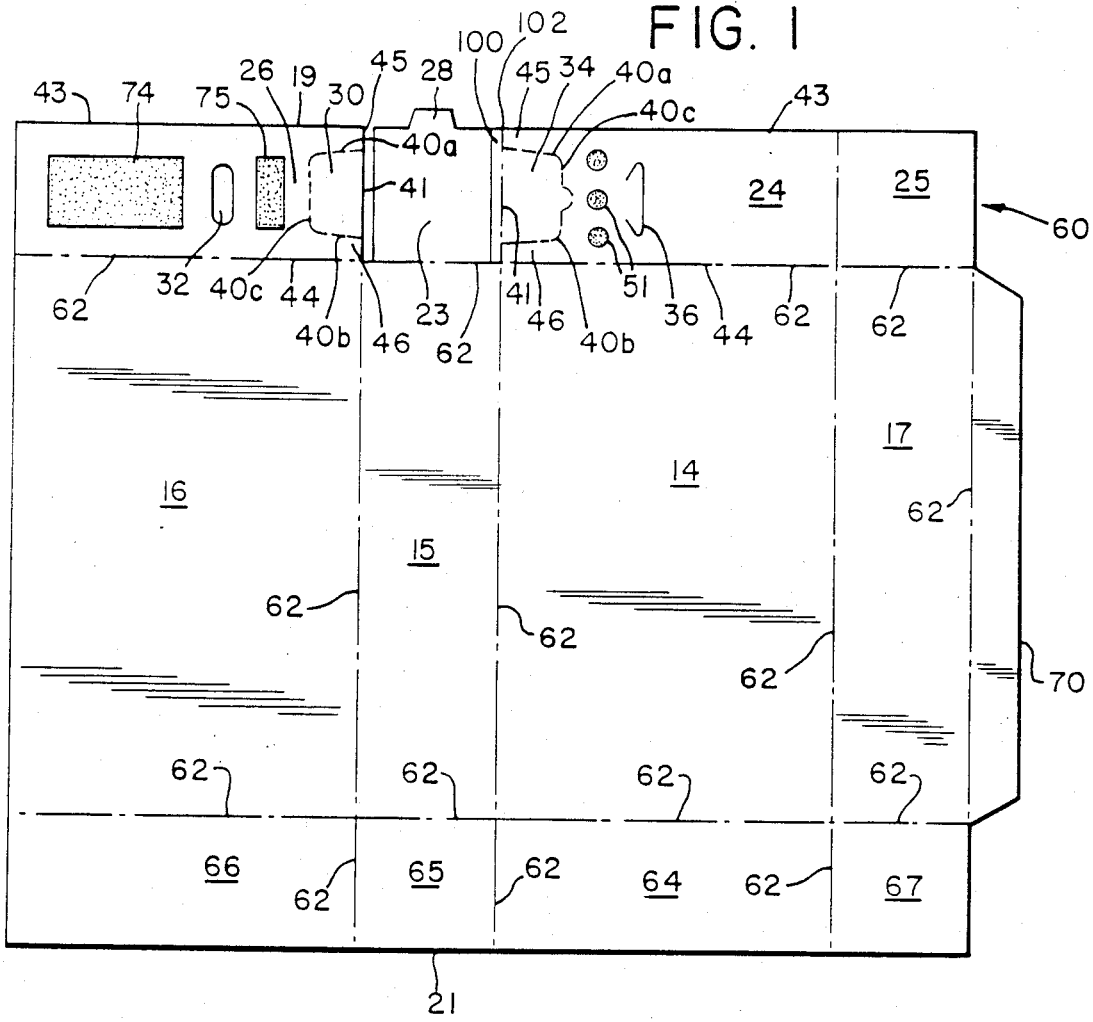
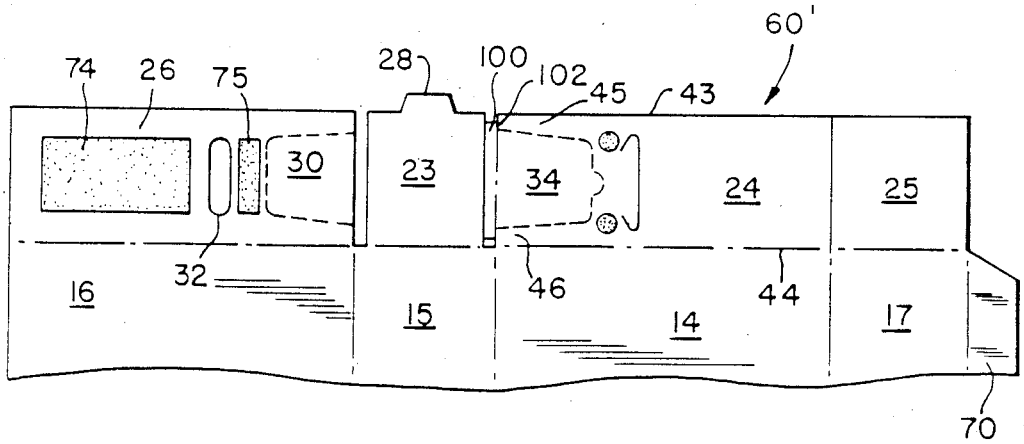
FIG. 10

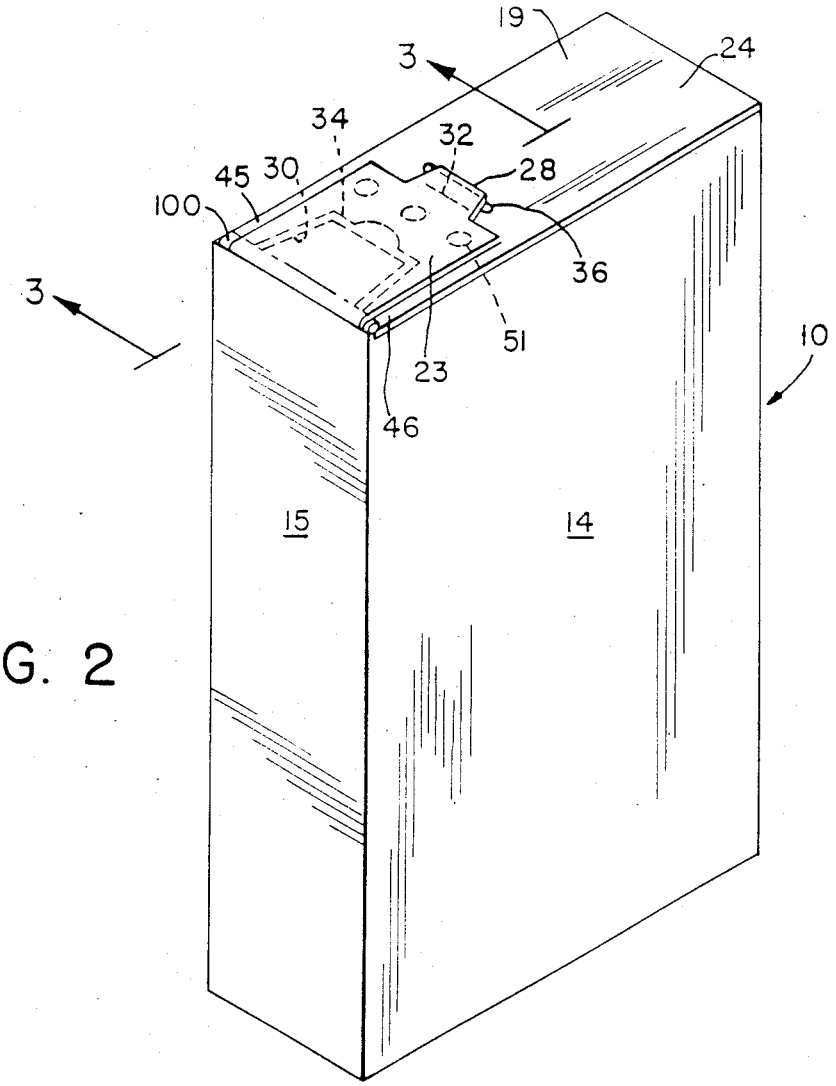
FIG. 2
FIG. 3
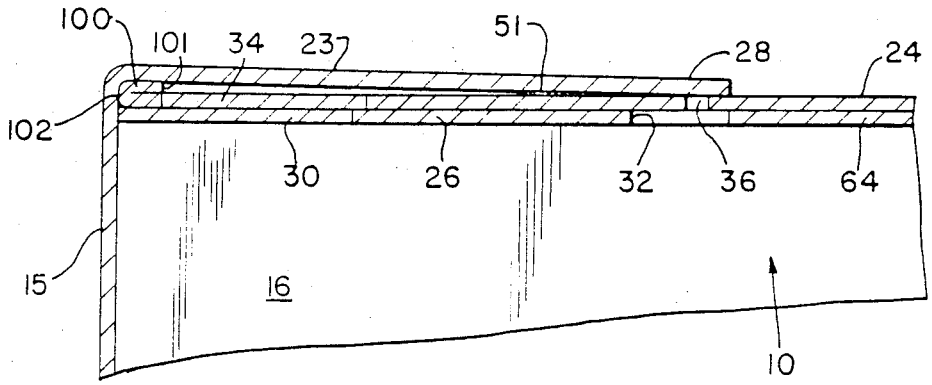

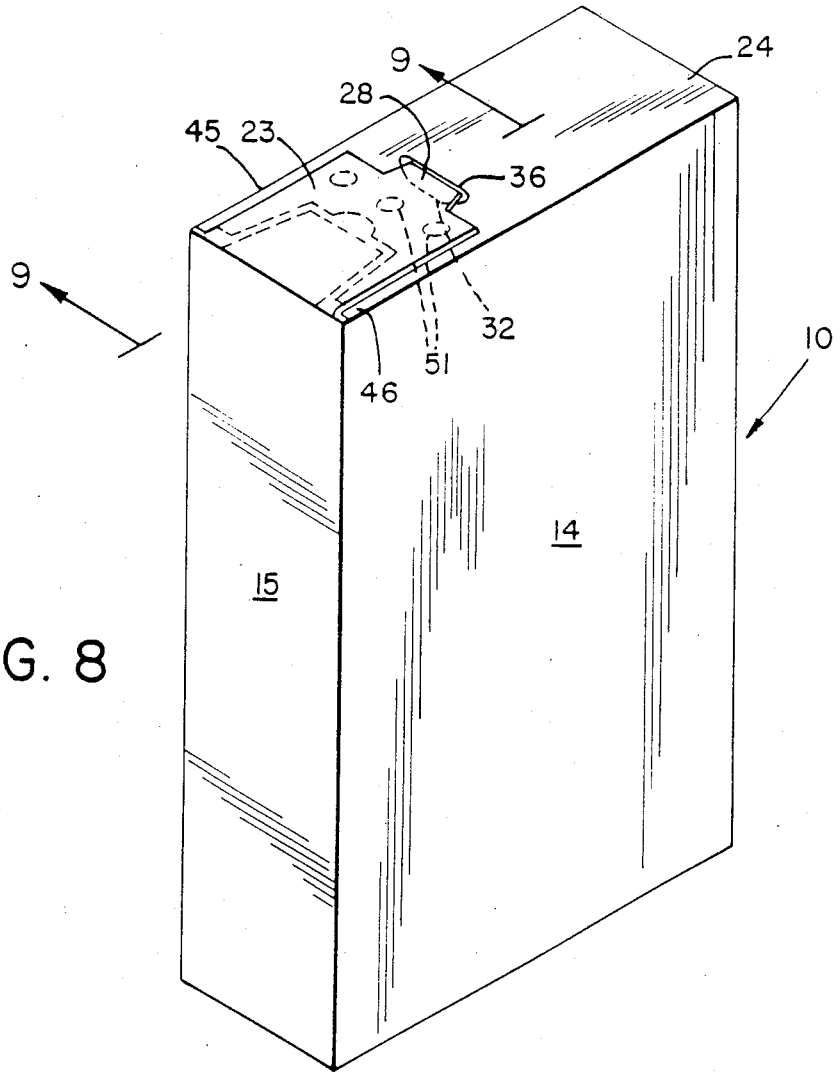
FIG. 8
FIG. 9
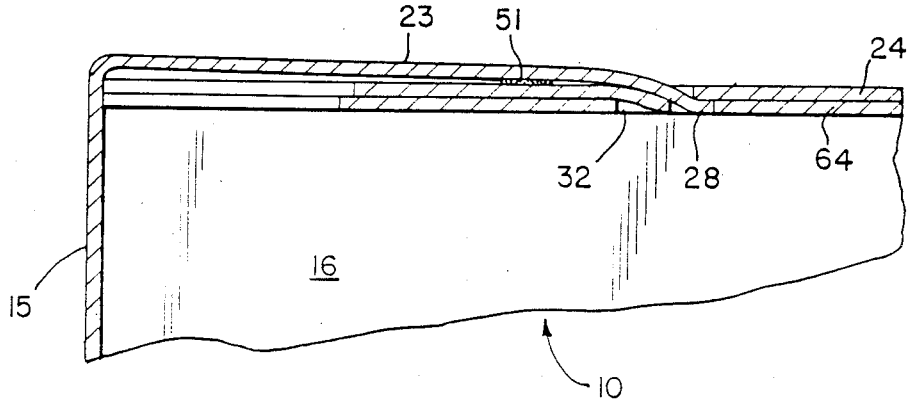

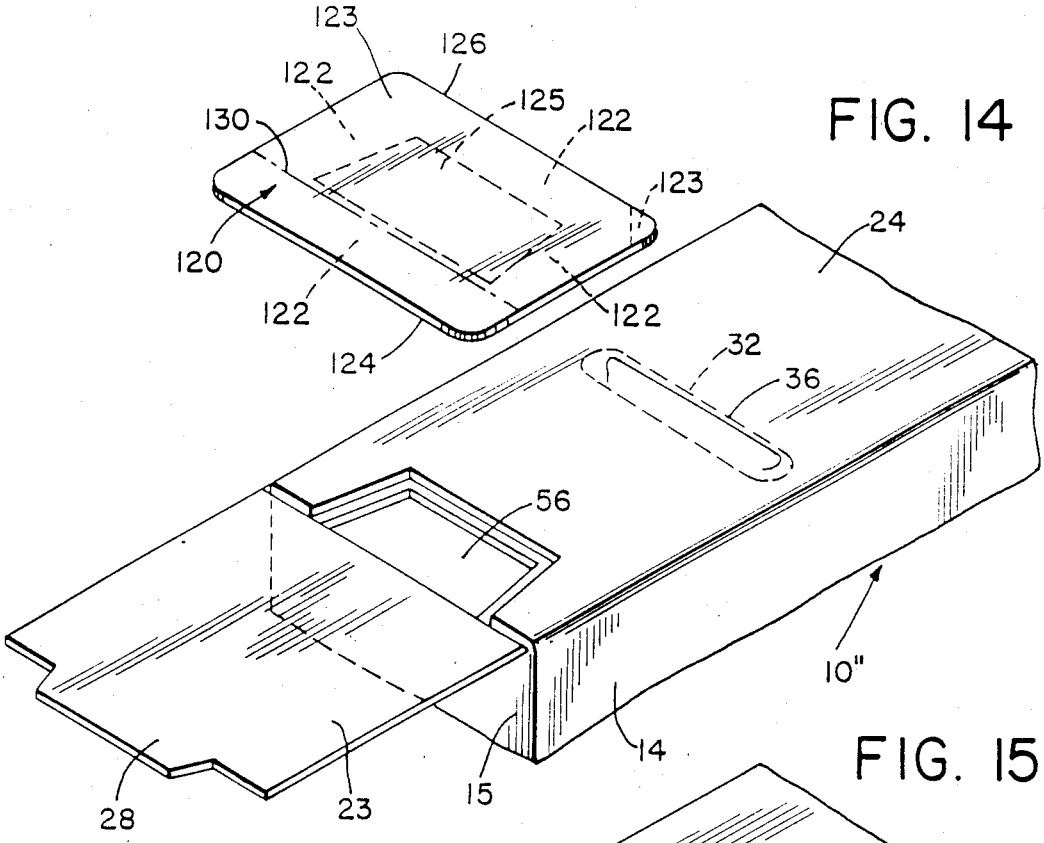
FIG. 14
FIG. 15
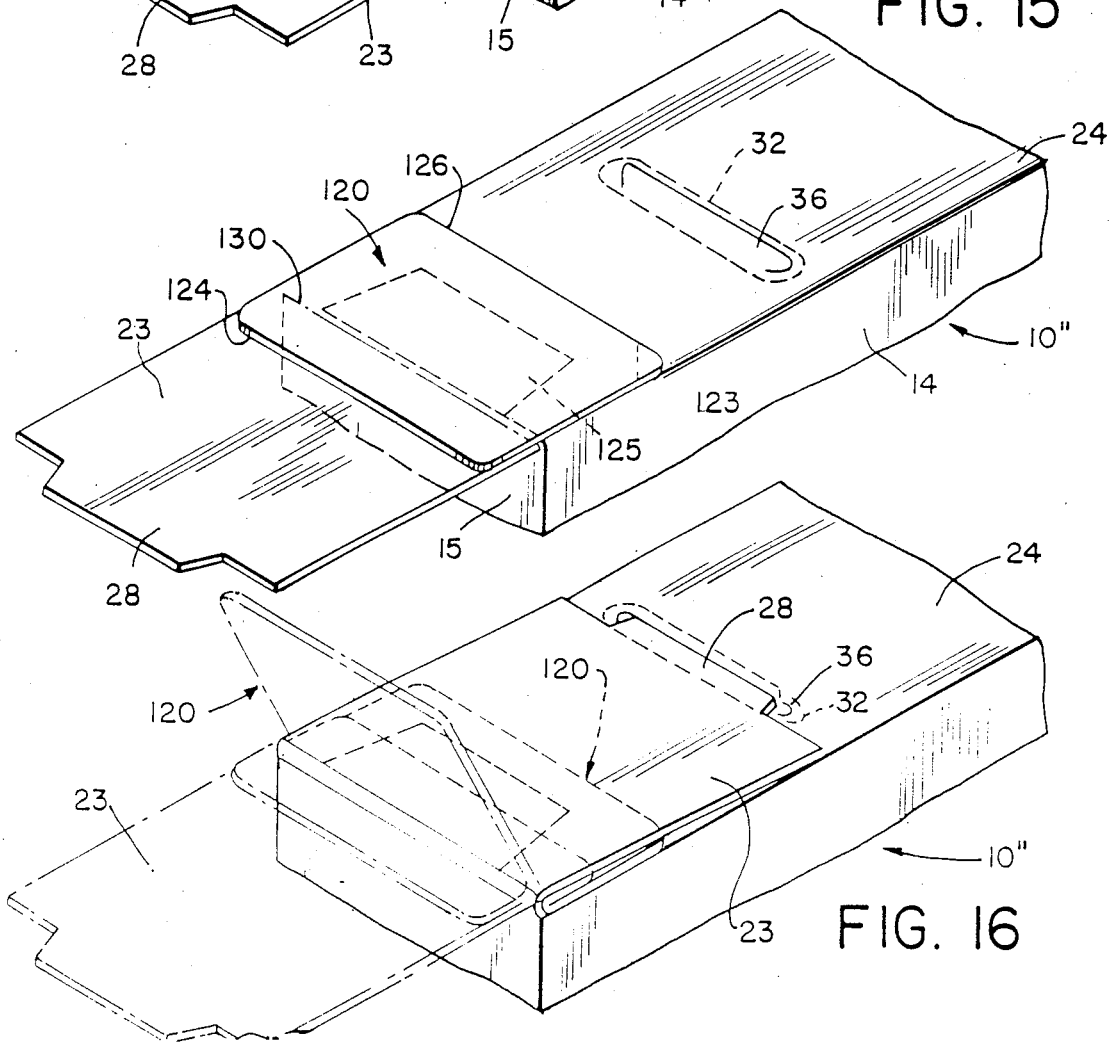
FIG. 16

FIG. 17
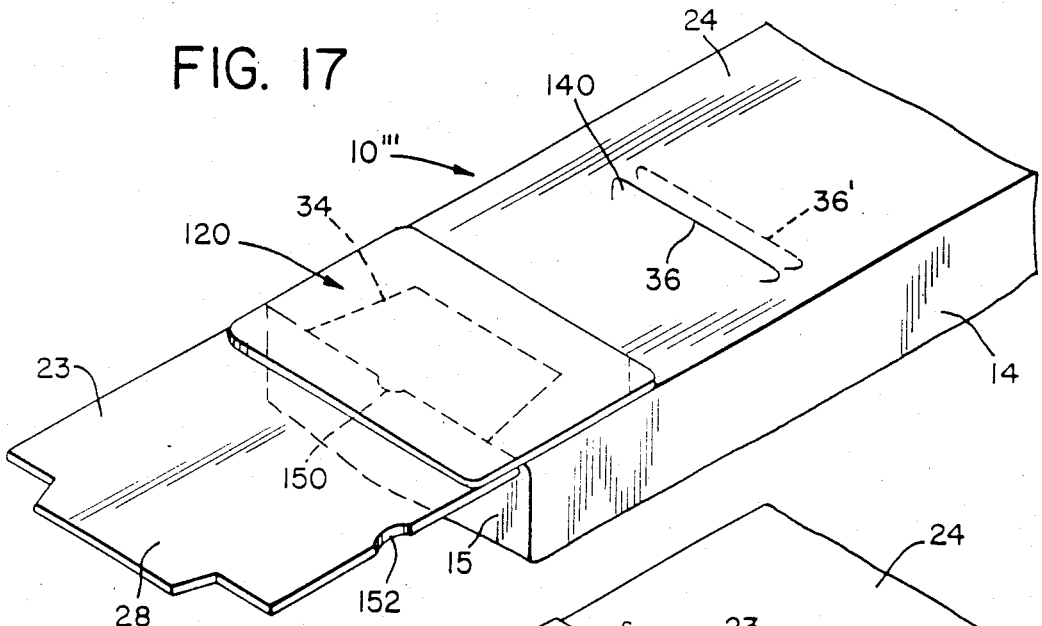
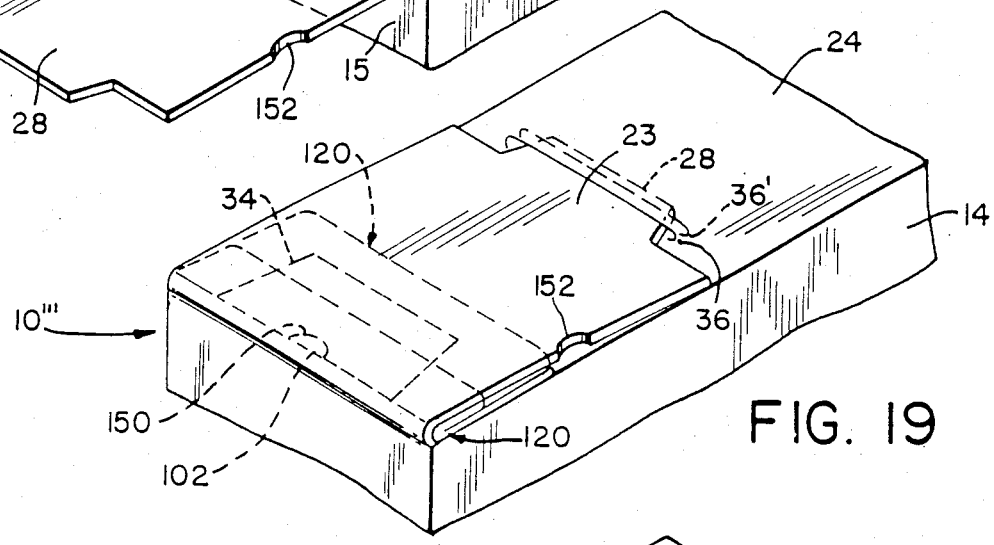
FIG. 19
FIG. 18
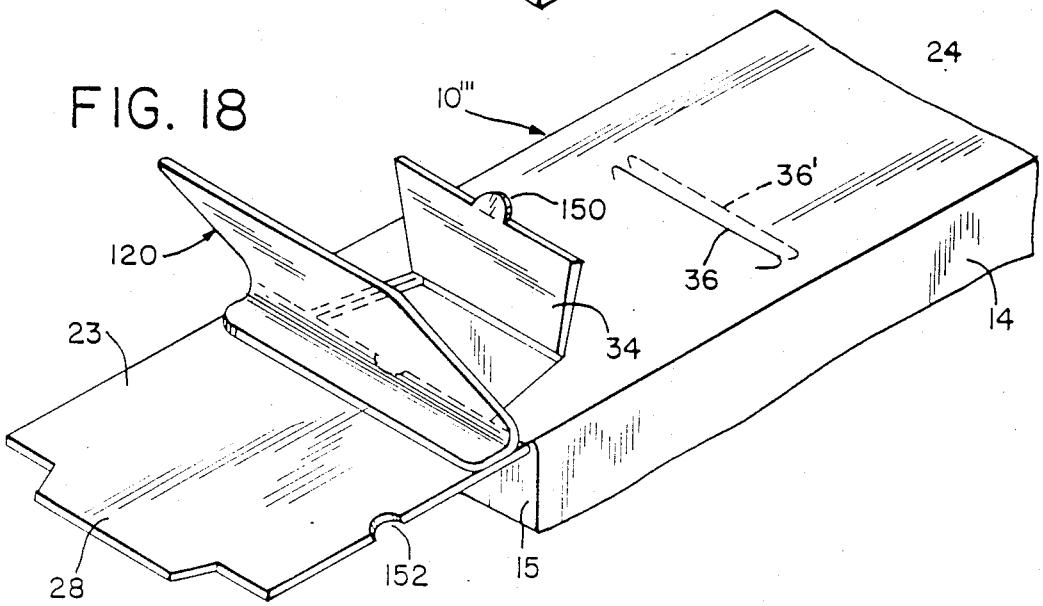

SIFT-PROOF CARTON AND BLANK THEREFOR

This is a divisional of co-pending application Ser. No. 0/344,972 filed on Apr. 27, 1989, now Pat. No. 4,941,575 issued July 17, 1990.

BACKGROUND OF THE INVENTION

The present invention relates generally to an easy opening, reclosable carton, and more particularly to a sift-proof easy opening, reclosable paperboard folding cartons and to blanks from which such cartons are made.

For the purposes of the following specification and claims, the dimensions of "length" and "width" referred to the easy opening end of the closed erected carton, with the length being the maximum dimension of the end and the width (sometimes called "thickness") being the minimum dimension of the end. The dimension of "depth" (sometimes called "height") refers to the remaining dimension of the carton. The dimensions of length L, width W and depth D are illustrated in FIGS. 1 and 2 for a top-opening carton. While the drawings, specification and claims define the present invention in the context of a top-opening carton, clearly the same principles are applicable to a side opening carton.

U.S. Pat. No. 4,718,557 discloses a carton structure providing an easy opening feature, yet being relatively strong prior to the initial opening to maintain product integrity during shipping, handling and sale, and a reclosable feature to maintain product freshness and/or prevent product contamination or spillage after the initial opening.

Easy opening cartons in general, including those described in U.S. Pat. No. 4,718,557, are subject to sifting. "Sifting" refers to the process by which fine particulate matter such as flour, soap powders, cereal and the like which the carton is intended to hold escape from the interior of the carton to the exterior of the carton. In an easy opening carton, sifting is most pronounced where the minor end panel is an exterior end panel overlying the major end panels, and negligible where the minor end panel is an interior end panel underlying one or both of the major end panels. The particulate matter escapes through the gap between the exterior minor end panel and the major end panels which it overlies and, more particularly, through the gap between the foldline or vertex of the minor end panel and the side panel from which it extends and the major end panels. The finer the particulate matter within the carton, relative to the gap, the greater the likelihood and extent of sifting. The sifting may occur during storage, transport or handling of the unopened sealed carton, especially when the carton is turned upside down or on its side.

To the extent that the escaping particulate matter lands on the shipping carton, retail store shelf or the like, it reduces the initial packed weight of the carton (so that the customer may not be receiving as much of the product as he is paying for) and, depending upon the nature of the product, may create an undesirable mess within the shipping container or, worst yet, on the retail store shelf. Even where the escaping product remains exclusively on the outer surface of the carton, it may create a messy appearance or an irregular or otherwise undesirable feel to the carton, thereby rendering it unacceptable to prospective purchasers. In any case, the visible evidence of sifting is generally sufficient to discourage a potential purchaser from purchasing the carton in question.

Accordingly, it is an object of the present invention to provide an easy opening, reclosable carton which is sift-resistant and preferably substantially sift proof.

Another object is to provide a blank from which such a carton may be formed.

SUMMARY OF THE INVENTION

The above and related objects of the present invention are obtained in a carton having sides and ends defining a rectangular parallelepiped. The sides are formed by side panels and the ends by end panels, one of the carton ends comprising first, second, and third end panels which are connected to first, second and third side panels, respectively. The first and third end panels extend from the first and third side panels, respectively, a substantial distance towards the third and first side panels, respectively, in an at least partially overlying relationship. The second end panel is pivotably connected to the second side panel and extends partially over the first and third end panels. Means adhere the second end panel to the outer of the first and third end panels while permitting the second end panel to be separated from the outer end panel and pivoted to expose the previously underlying portion of the outer end panel. The sift proof feature of the present invention is obtained by providing at least one of the first and third end panels (preferably the outer end panel) with a length in excess of the side panel from which it extends. The excess length is at least partially compacted and folded against the outer end panel by the second end panel when the second end panel extends partially over the first and third end panels, thereby providing a sift-resistant carton.

In a preferred embodiment, the excess length is compacted and folded at least partially over the outer end panel. The excess length may be secured at its free end to the second end panel. Preferably the second end panel has a width less than that of the carton by at least the excess length, typically less than that of one of the first and third end panels and in particular less than that of the outer end panel. The second end panel is spaced by at least the excess length from the vertex or axis of intersection between the second side panel and an adjacent side panel.

In one embodiment, the first end panel includes a first region which is weakened and is defined by at least one weakened portion in which that end panel is at least partially cut through, the third end panel includes a second region which is weakened and is defined by at least one weakened portion in which that end panel is at least partially cut through and an open region. The first and second regions are disposed in an overlaying relationship adjacent the second end panel, the second end panel fully overlaying at least the outer of the first and second regions in the outer end panel, and the pivoting of the second end panel exposing the outer region. The first or second region in the inner end panel of the first and third end panels may be removed.

The present invention further comprises a sheet-like blank for forming a carton having side panels and end panels. The blank comprises at least four side panels and at least three end panels, with first, second and third end panels being foldably connected to first, second and third side panels, respectively. Each of the first, second and third end panels is defined by opposed ends and opposed sides, one of the ends of each of the first, second and third end panels being connected to a respective side panel, and the first and third end panels each extending from the respective side panel a distance which is substantial compared to the width between opposed sides of the second side panel. One of the first and third end panels has a length in excess of the side panel from which it extends, with the excess length being adapted to be at least partially compacted and folded against one of the first and third end panels by the second end panel when the second end panel extends partially over the first and third end panels, thereby providing a sift-resistant carton blank.

The present invention further encompasses a carton wherein the excess length is provided by an insert having one surface thereof secured adjacent one end to said second panel and adjacent the other end to said outer end panel, thereby providing a sift-resistant carton. In a preferred embodiment the insert extends the full width of the carton, is folded at least partially between the outer end panel and said second end panel, and is resealably secured at the other end to the outer end panel. The insert is not visible from outside the closed carton when the second end panel overlays the outer end panel. The insert surface has pressure sensitive adhesive over a major portion thereof. Preferably the first end panel includes a first open region and the third end panel includes a second open region, the first and second open regions being disposed in an overlaying relationship adjacent the second end panel. The second end panel fully overlies the insert and at least the outer of the first and second open regions in the outer end panel, pivoting of the second end panel exposing the insert and removal of the insert exposing the first and second open regions. Preferably the insert covers the outer open region and the insert surface is adhesive-free opposite the outer open region.

The present invention additionally encompasses a carton —— which may or may not have an added length or insert —— wherein the first and third end panels each define a respective slit therethrough adapted to receive a portion of the free end of the second end panel. The slits are adjacent one another but slightly offset along the longitudinal axis of the carton end to preclude sifting through aligned slits while still enabling the tab defined by the slit of the outer end panel to be partially received in the slit of the inner end panel and the free end portion of the second end panel to be received through both of the slits. Preferably the slit of the other end panel is further removed from the second side panel and larger than the slit of the inner end panel.

Lastly, the present invention further encompasses a carton —— which may or may not be a sift-proof carton —— additionally having tab means disposed at the end of one of the weakened regions for facilitating removal thereof from its end panel. The tab means is formed by one of the first and third end panels having a longitudinal portion with a length in excess of the side panel from which it extends. The tab means is folded against the outer end panel by the second end panel when the second end panel extends partially over the first and third end panels and exposed for grasping when the second end panel is pivoted away from the first and third end panels. Preferably the tab means is disposed on the end of the weakened region adjacent the vertex of the second end panel and the second side panel, has a width substantially less than that of the weakened region on which it is disposed, and is disposed on the weakened region of the outer end panel. The second end panel has a width at one point less than that of the carton by at least the length of the tab means.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein:

FIG. 1 is a top plan view of a one-piece blank according to the present invention from which the carton may be made;

FIG. 2 is an isometric view of a sift-proof easy opening, reclosable carton according to the present invention, made from the blank of FIG. 1, in the erected, closed and sealed state;

FIG. 3 is a sectional view of the carton taken along the line 3—3 of FIG. 2;

FIG. 8 is a perspective view of the carton after it has been opened and reclosed;

FIG. 9 is a sectional view taken along the line 9—9 of FIG. 8;

FIGS. 10, 11, 12 and 13 are views similar to FIGS. 1, 4, 7 and 8, but showing a second embodiment of the present invention; and FIG. 14 is a fragmentary isometric view of the easy opening, reclosable end of a carton according to a third embodiment of the present invention prior to application of a separate insert to the carton;

FIG. 15 is a fragmentary isometric view of the carton after application of the insert thereto;

FIG. 16 is a fragmentary isometric view of the carton after it has been opened and reclosed, with the carton being shown in the open position in phantom line;

FIG. 17 is a fragmentary isometric view of a carton according to a fourth embodiment of the present invention prior to sealing of the carton;

FIG. 18 is a fragmentary isometric view of the carton after has been opened and the tab used to pivot outwardly the weakened region of the outer panel; and FIG. 19 is a fragmentary isometric view of the carton after it has been reclosed.

DETAILED DESCRIPTION OF THE PREFERRED EMBODIMENTS

Figure 4:
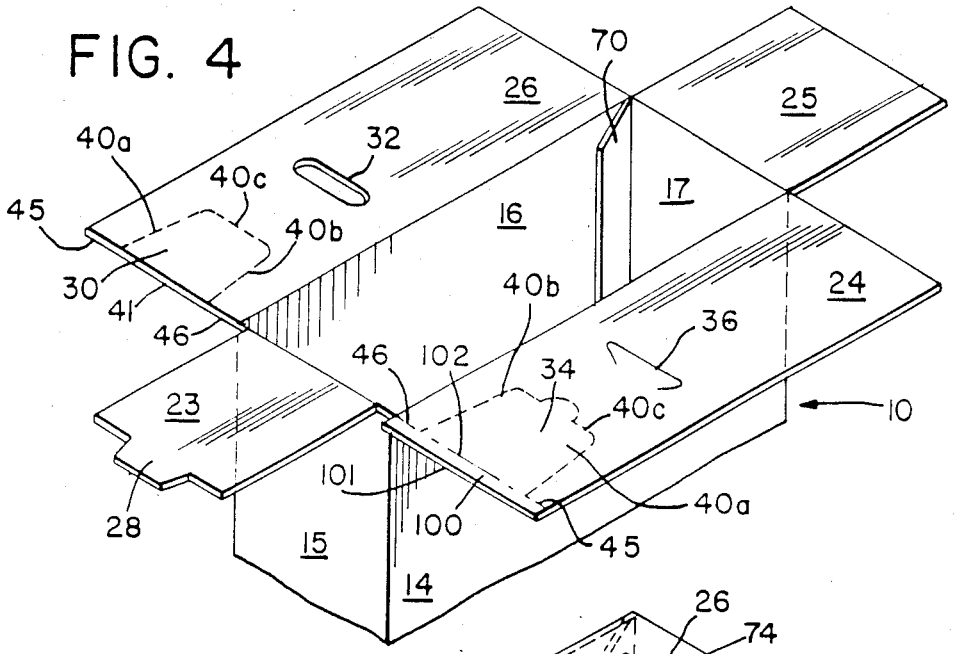
FIGS. 4 through 6 are fragmentary isometric views of the easy opening, reclosable end of the carton showing successive steps in the closing of the end.

Referring now to the drawing, and in particular to FIGS. 2 and 3, therein illustrated is an easy opening, reclosable carton generally designated by the reference numeral 10 in accordance with the present invention, depicted in its erected, closed and sealed configuration. (FIG. 1 illustrates a blank from which the carton 10 may be constructed.) The carton 10 has the configuration of a rectangular parallelepiped and includes first, second, third and fourth side panels 14, 15, 16 and 17, a top end 19 and a bottom end 21 (only the first and second side panels 14, 15 and the top end 19 being visible in FIG. 2). The top end 19 is formed by first and third large end panels 24 and 26 (only first end panel 24 being visible in FIG. 2), and second and fourth small end panels 23 and 25 (only end panel 23 being visible in FIG. 2).

The first and third side panels 14, 16 are referred to as major face panels, and the smaller second and fourth side panels 15, 17 are referred to as minor face panels. The first and third end panels 24 and 26 are referred to as major end panels, and the smaller second and fourth end panels 23, 25 are referred to as minor end panels. In FIG. 2 only the major side panel 14, the minor side panel 15, the major end panel 24, and the minor end panel 23 are visible. Because the major end panel 24 lies over the major end panel 26 in a closed carton, the major end panel 24 is referred to as the outer or external major end panel while the major end panel 26 is referred to as the inner or internal major end panel. Similarly, because the minor end panel 23 overlies the major end panels 24, 26, it is referred to as the outer or external minor end panel, while the minor end panel 25 which lies under the major side panels 24, 26 is referred to as the internal or interior minor side panel.

Each of the top end panels 23, 24, 25 and 26 is connected at a respective end thereof to side panels 15, 14, 17 and 16, respectively. Bottom end 21 is also formed by major and minor end panels (not shown in FIG. 2), but with both minor end panels underlying both major end panels so that there exists little likelihood of sifting. Thus, the first end panel 24 is connected to first side panel 14, second minor end panel 23 is connected to second minor side panel 15, etc.

Carton 10 includes in its top end 19 a structure incorporating an easy opening feature and a reclosable feature as described in U.S. Pat. No. 4,718,557, the substance of which is hereby incorporated by reference. According to this patent, a tab or projection 28 of the external minor end panel 23, a weakened region 30 and opening 32 of internal major end panel 26 and a cut away, open or weakened region 34 and a slit 36 of external major end panel 24 cooperate to provide the easy opening and reclosable features.

Weakened region 30 of internal major end panel 26 (also referred to as a "flap") is defined by weakened portions illustrated by lines 40, which are at least partially cut through the panel, and by the edge of first side 41 of panel 26. The weakened portions illustrated by lines 40 are preferably formed by a nick cut in which the panel is fully cut through in the solid portions of lines 40 and is not cut through in the broken portions of lines 40. The length of the uncut portions may be selected in accordance with the relative strength desired for weakened region 30 (or, conversely, the relative ease desired for severing weakened region 30). A weakened region 30 defined entirely by nick cut portions and panel edge 41 is presently preferred; however, weakened region 30 may also be formed by various combinations of weakened portions including perforations, kiss cuts, nick cuts and scoring, and panel edges, etc., so long as the major part of the weakened portions are at least partially cut through end panel 26 to facilitate at least partial severing of weakened region 30 from end panel 26. Alternatively, the weakened region 30 may be entirely removed from carton 10 during the manufacture thereof (and in fact during creation of the blank 12 therefor), albeit with a possible slight diminution in the sift-proof feature of the present invention as described hereinafter.

Lines 40 extend from first side 41 of inner major end panel 26 inwardly thereof. In the embodiments depicted, line portions 40*a* and 40*b* extend at an angle to the opposed ends 43, 44 of the panel (i.e., generally diagonally) towards each other; however, portions 40*a* and 40*b* may also extend parallel to the opposed ends and to one another. One reason for extending line portions 40*a* and 40*b* at an angle to the panel ends, rather than parallel thereto, is that such diagonally extending weakened portions tear more easily than parallel weakened portions. Lines 40 include a third line portion 40*c* which extends transversely across inner major end panel 26 from line portion 40*a* to line portion 40*b*. Lines 40 defines a generally U shaped weakened portion. However, other configurations are acceptable, for example, a generally V-shaped weakened portion in which line portions 40*a* and 40*b* directly intersect each other. Line portion 40*b* extends from a point inwardly of the vertex of formed by the intersection of side 41 and end 44 of inner major end panel 26, while line portion 40*a* extends from a point inwardly of the vertex formed by the intersection of side 41 and end 43 of panel 26. There is thus an unweakened region 45 in end panel 26 adjacent line 40*a* and an unweakened region 46 in end panel 26 adjacent line 40*b*. During opening of the carton, region 30 is completely severed from end panel 26 along lines 40, and an opening is created bounded by unweakened region 45 on one side and unweakened region 46 on the other side.

As illustrated in FIG. 3 of U.S. 4,718,557, external major end panel 24 includes a flap or weakened region 34, similar to the flap or weakened region 30 in internal major end panel 26. The weakened region 34 of external major end panel 24 is preferably slightly greater than in both length and width then the weakened region 30 of internal major end panel 26, although it may also be of the same size or even smaller in one or more of its dimensions. Weakened region 34 of external major end panel 26 is defined by weakened regions illustrated by lines 40, which are at least partially cut through the panel and by the edge or first side 41. Line portion 40*c* may be cut entirely through the panel 24 to leave the weakened region 34 secured to the panel 24 only at the sides thereof by lines 40*a* and 40*b*. For the puroses of the present invention, line 41 of weakened region 34 differs in certain respects from line 41 of weakened region 30, as will be explained hereinafter in greater detail. Unlike line 41 of weakened region 30, which represents a cut edge of internal major end panel 26, line 41 of weakened region 34 represents a foldline or weakened line (for example, containing nick cut portions) or a combination thereof within external major end panel 24.

Figure 5:
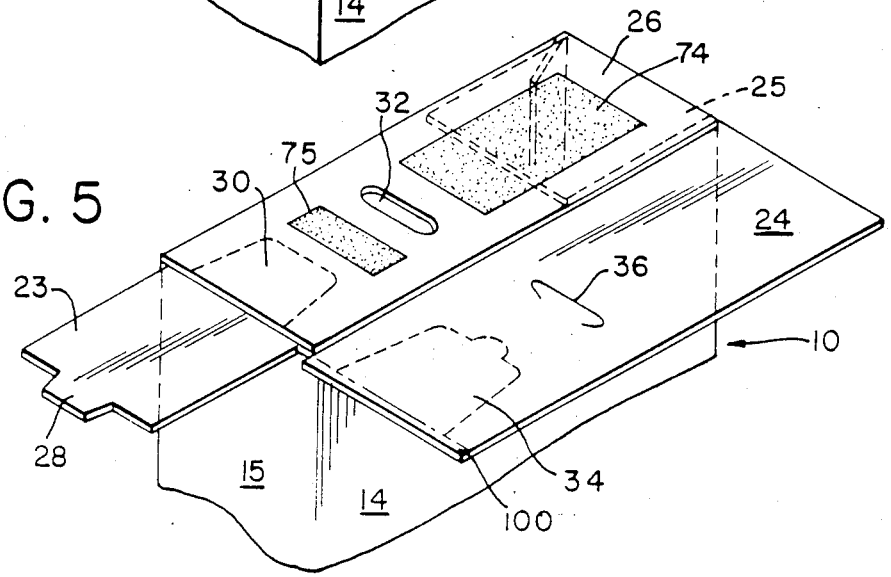
Figure 6:
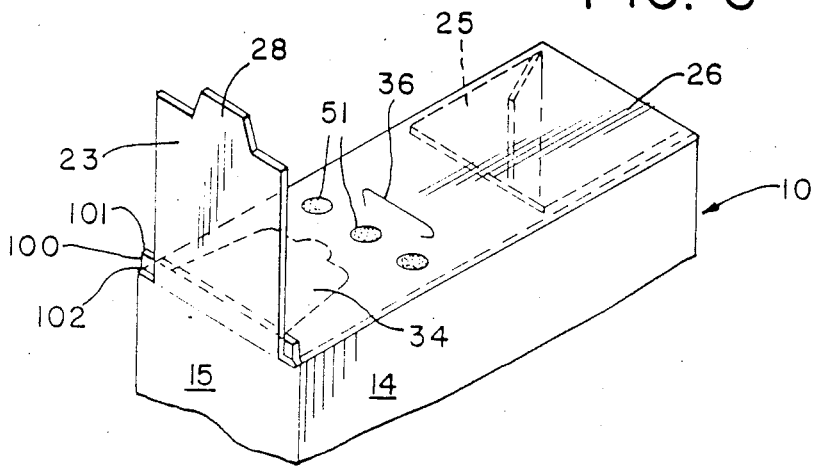

Referring now to FIGS. 4 through 6, FIG. 4 depicts carton 10 in its totally opened condition in which the various end panels 23, 24, 25, 26 are opened and extended. FIG. 5 depicts carton 10 in its partially closed condition in which internal minor end panel 25 has been folded first, then internal major end panel 26. FIG. 6 depicts carton 10 in a further closed condition in which the external major end panel 24 is folded over the internal major end panel 26. The weakened regions 30, 34 of the major end panels 26 and 24, respectively are located relative to each other on the respective panels so that when both are removed or displaced, an opening results through which the contents of the carton 10 may be poured out of the carton. To complete closing and sealing of carton 10, external minor end panel 23 is folded over external major end panel 24 (and, hence, also over internal major end panel 26) as depicted in FIG. 2. Major end panels 24 and 26 are glued together, as will be described more fully in connection with the blank of FIG. 1, and external minor end panel 23 is glued to external major end panel 24 as discussed below.

If desired, internal minor end panel 25 may be disposed intermediate major end panels 24 and 26, rather than below both; however, it should never be disposed above both panels, as this would interfere with the sift-free feature of the present invention. To facilitate lifting or opening of external minor end panels 23 after it has been glued to external major end panel 24. Glue is applied to panel 24 in discrete, separated, weakened regions 51, which are shaped as closed (e.g., circular) figures, and may be formed in the embodiment (see FIG. 6) by circular weakened portions in which end panel 24 has been partially cut through. By restricting glue to separated regions 51, not only is later separation of end panel 23 from end panel 24 to open the carton 10 facilitated, but, in addition, board delamination is minimized when end panel 23 is separated from end panel 24. Preventing substantial delamination maintains the integrity of end panel 23 and end panel 24 adjacent slit 36, so that operation of the reclosable feature is not substantially diminished. Circular regions 51 may be located on external minor end panel 23 instead of or in addition to circular regions 51 on external major end panel 24.

Figure 7:
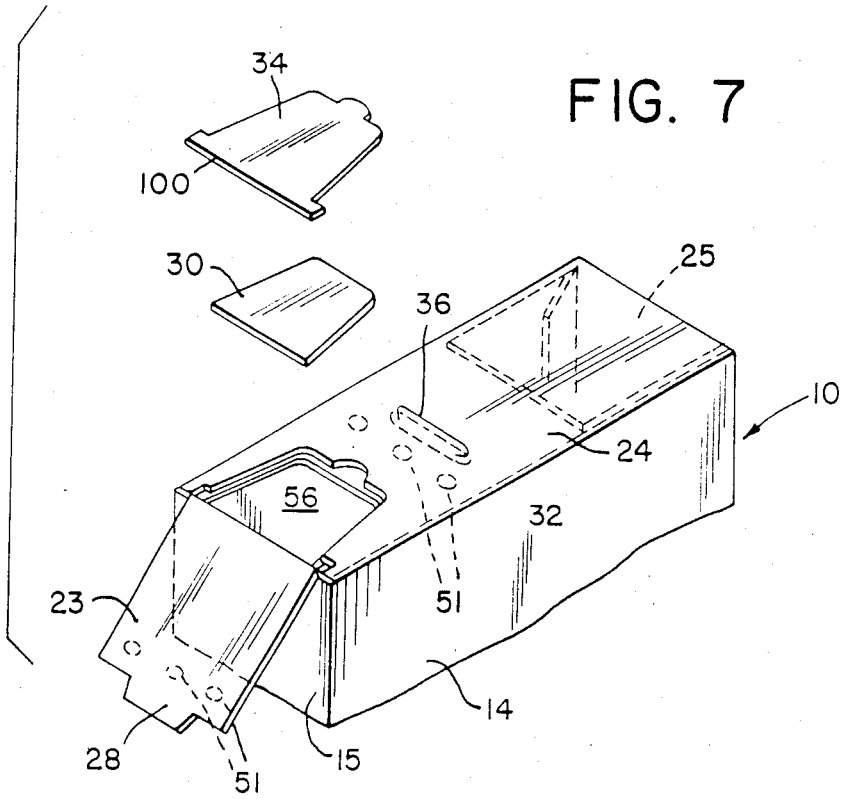
FIG. 7 is a fragmentary perspective view of the easy opening, reclosable end of the carton after it has been opened and the weakened regions removed.

Opening of a sealed carton 10 is described with reference to FIG. 7. Outer minor end panel 23 is separated from the outer major end panel 24 by grasping tab 28 and pulling or lifting the tab 28. As discussed above, separation is facilitated by restricting glue to circular regions 51 so that any delamination occurs in separated circulated areas 51 on end panels 23 and 24. After outer minor end panel 23 has been separated and pulled back as depicted in FIG. 7, weakened regions 30 and 34 are pushed inwardly or pulled outwardly from major end panels 26 and 24, respectively, along lines 40 and optionally severed from the carton. (As illustrated in FIG. 9, weakened region 30 has been removed, but weakened region 34 has merely been pulled back.) This forms a generally wedge-shaped pour opening 56. The contents of carton 10 may be removed through opening 56, which is at the top of the carton. Opening 56 is, therefore, fully visible during pouring and "blind side" pouring is avoided. End panel 23 may also act as a pouring spout to assist in guiding the contents of the carton during pouring. In an alternative embodiment (not shown), weakened region 34 of outer major end panel 24 may be glued to outer minor end panel 23 so that it is torn away from the outer major end panel 24 and pulled back with the outer minor end panel 23 when outer minor end panel 23 is unsealed and pivoted open.

Reclosing of an opened carton 10 is described with reference to FIGS. 8 and 9. To reclose an opened carton 10, outer minor end panel 23 is reclosed (i.e., disposed against outer major end panel 24) and tab 28 is inserted into slit 36 of outer major end panel 24. Opening 32 in inner major end panel 26, which is below slit 36, facilitates insertion of tab 28 into slit 36. Structure other than tab 28, slit 36 and opening 32 may be used to interconnect outer minor end panel 23 to one of the other end panels. If desired, tab 28 may include a generally half-moon projection or recess which facilitates grasping of the tab during the initial and subsequent openings of the carton.

For particular applications, it may be desirable to provide opening 32 on external major end panel 24 and slit 36 on internal major end panel 26. If desired, the weakened region 30 of the internal major side panel 26 may have one edge thereof defined not by nick cut portions, but rather by a foldline so that, when the weakened region 30 is pushed into the carton, it separates from the internal major end panel 26 along two sides, but not along the third side defined by the foldline. As a result, the weakened portion 30 will remain attached to the panel 26 within the carton. If desired, instead of gluing together the major end panels 24 and 26, the outer major end panel 24 may include an edge portion or glue flap (not shown) which is glued to the major side panel 16 of the carton. These variations do not affect the principles of the present invention as it relates to the easy opening, reclosable and sift proof features.

Referring now to FIG. 1, blank 60 may be glued and folded to form carton 10 of FIG. 2. Blank 60 is a one-piece blank made of a homogeneous sheet material, such as paperboard or the like, and includes weakened regions 62 shown as broken lines along which blank 60 may be folded. Weakened regions 62 are preferably score lines disposed to define first, second, third and fourth side panels 14, 15, 16 and 17; corresponding first, second, third and fourth top end panels 24, 23, 26 and 27; and corresponding bottom end panels 64, 65, 66 and 67. In addition, one weakened region 62 defines a glue panel or flap 70 which is connected to side panel 17. The solid lines in FIG. 1 within blank 60 represent cuts which form sides of the end panels. The reference numbers in FIG. 1 correspond to those in FIG. 2.

Glue is conventionally applied to bottom end panels 64-67 and to glue flap 70. Glue is also applied to selected regions of the top end panels in order to provide the easy opening, reclosable features. Specifically, glue is applied to regions 74 and 75 of internal inner major end panel 26, to regions 51 of outer major end panel 24, and optionally to additional areas. Referring now to the sealed configuration of FIGS. 2-3, glue regions 74 and 75 of inner major end panel 26 are disposed on the top of end panel 26, and glue regions 51 are disposed on the top of outer major end panel 24. Optionally, glue may be applied to inner minor end panel 25 or inner minor end panel 24 adjacent end panel 25, so that the top of inner minor end panel 25 will be glued to the bottom of inner major end panel 24. Major glue regions 74 and 75 are disposed between closed major end panels 22 and 24, and glue regions 51 are disposed between end panels 23 and 24. Alternatively, glue may be applied to the opposite facing panel surface rather than to the panel surfaces described above.

Blank 60 may be glued and erected with standard folding carton machinery as follows. First, glue flap 70 is glued and adhered to major side panel 16 to form a flat knocked-down, partially assembled blank which may be shipped in that form to a location where it will be filled with product. Prior to erection of carton 10 for filling, glue is applied to regions 51, 74 and 75 (or glue previously applied to those regions is activated). Blank 60 is then folded along lines 62 to form a rectangular parallelepiped structure a depicted in FIG. 4, with top and bottom ends open. Thereafter, end panels 23, 24, 25 and 26 of top end 19 are folded as described in connection with FIGS. 4-6 and 2-3 and sealed together. The carton is then filled from the bottom end 21, and glue is applied to selected ones of the bottom end panels (or previously applied glue is activated). The bottom end panels are then closed and sealed conventionally. Blank 60 may also be glued and erected according to other procedures.

With the exception of the flap or weakened region 34 and its top edge line 41, the features of the basic easy opening, reclosable carton 10 described above are consonant (both in terms of structure and in the reference numerals used to describe elements of the structure) with the invention disclosed in U.S. Pat. No. 4,718,557, and in particular FIG. 3 thereof, except as noted. Accordingly, no further description of the basic easy opening, reclosable carton is deemed necessary herein. It should be appreciated, however, that the principles of the present invention relating to the sift proof feature, as described hereinafter, are equally applicable to other easy opening, reclosable cartons and, indeed, to easy opening cartons which are not reclosable.

Turning now specifically to the present invention and referring in particular to FIGS. 1–3, the sift-proof feature of the present invention may be obtained simply and without additional per carton cost simply by reducing the width of the outer minor end panel 23 (that is, the second end panel) relative to the width of the carton 10 and increasing the length of the outer major end panel 24 (that is, the first end panel) by some portion of that diminished width so that the length of the outer major end panel 24 exceeds the length of the major face panel 14 (that is, the first side panel) from which it extends. The excess length 100 is connected to the body of the outer major end panel 24 by the foldline 102 of what would otherwise be the edge or first side 41 of end panel 24. It will be appreciated that this excess length addition to the length of the outer major end panel 24 is achieved at the expense of the width of the outer minor end panel 23 and without incurring any additional per unit cost to the manufacturer in terms of either carton material or manufacturing process costs.

Thus the outer minor end panel 23 has a width less than that of the carton 10 by at least the excess length 100. In the embodiment illustrated, the width of the outer minor end panel 23 is less than that of one of the major end panels 24, 26 (and in particular the outer major end panel 24), and preferably less than that of either of the major end panels 24, 26. More particularly, the outer minor end panel 23 is spaced by at least the excess length 100 from the vertex or axis of intersection between the minor side panel 1 from which it extends and the adjacent major side panel 14. Although it plays no role in providing a sift-free feature to the carton, for the sake of symmetry a portion of the opposite side of the outer minor end panel 23 (preferably of identical configuration to the excess length 100) may be cut away therefrom so that the panel 23 appears to be centered relative to the second minor side panel 15 from which it extends.

At least one of the weakened regions 30 or 34 of major end panels 26 or 24 must be present in the sealed carton 10, preferably the weakened region 34 of the outer major end panel 24, and most preferably both. If desired, however, one of the weakened regions 30, 34, preferably the weakened region 30, may be absent from the sealed carton 10.

Referring now to FIG. 6, during the initial closing and sealing of the carton, the lowering of the outer minor end panel 23 onto the outer major end panel 24 causes the excess length 100 to become at least partially compacted and folded over and against the panel 24. As best shown in FIGS. 2–3, the bulk of the compacted and folded over portion of the excess length 100 acts as a barrier to the escape from the carton interior of any of the particulate matter which may have passed through the gap between the major end panels 24, 26 and the outer minor end panel 28.

To provide an even more thoroughly sift-proof carton, the free end 101 of the excess length 100 (that is, the side extending towards the outer minor end panel 23) may be glued or otherwise secured to the outer minor end panel 23 during the closing and sealing operation (or previously applied glue activated). For example, a region of glue may be provided on either the bottom of outer minor end panel 23 or the upper face of a portion of the free end 101 of excess length 100.

The short portions of the excess length 100 extending to either side of the outer minor end panel 23 of the sealed carton 10 will assume and maintain the compacted and folded over configuration assumed by the intermediate portion of the excess length underlying the panel 23. The excess length 100 preferably extends the full width of the carton 10 (that is, is at least as wide as the overlapped width of the major end panels 24, 26), as illustrated in FIGS. 1–9, but it may be slightly less, as illustrated in FIGS. 10–13. In particular applications, the excess length 100 may even be of lesser width than the outer minor end panel 23, albeit with a possible diminution of the sift-free effect.

The length of the excess length 100 is preferably just sufficient to cause the excess length to become at least partially folded over the outer major end panel 24 during the closing and sealing steps. Lengths of 5 to 20 millimeters have been found satisfactory although shorter and longer lengths may be used depending upon the materials employed, whether the excess length 100 will be secured to the outer minor end panel 23, and the like.

While in the preferred embodiments of the present invention, the excess length 100 is a part of the outer major end panel 24 (or an extension thereof), alternatively the excess length 100 may be a part of the inner major end panel 26 (or an extension thereof). In this case, the excess length 100 must pass between the edge or first side of the outer major end panel 24 and the outer minor end panel 23 before being compacted and folded over the outer major end panel 24.

If it is desired to retain a full width outer minor end panel 23 (that is, a panel 23 having a width comparable to the minor side panel 15 or overall carton 10), a separate insert generally comparable to excess length 100 in size and configuration may be positioned between the panels 23 and 24 during the carton sealing step. This insert may be formed from the same material as the carton (and indeed created from the same blank 60) or from a different material. The insert may be loosely inserted into place during the sealing step so that, upon opening of the carton, it falls away from the carton. Alternatively and preferably, one end of the insert is glued to the panel 23 or 24 against which it will rest and, most preferably, each end of the insert is glued to the respective panel 23, 24 against which it will rest. Where the insert is adhered to major end panel 24, it effectively increases the length of panel 24 relative to the major side panel 14 from which it extends. The insert is conveniently formed of a pressure sensitive label having a width comparable to that of the carton and a length sufficient to enable it to be adhered to both panels 23, 24. A major disadvantage of the use of such an insert is that at the least extra processing steps or equipment are required to position the insert within the carton being sealed and to adhere one or both ends of the insert to the panels 23 or 24. Additionally, if the insert is to be glued to either or both of the panels 23, 24, additional glue is required.

Figure 11:
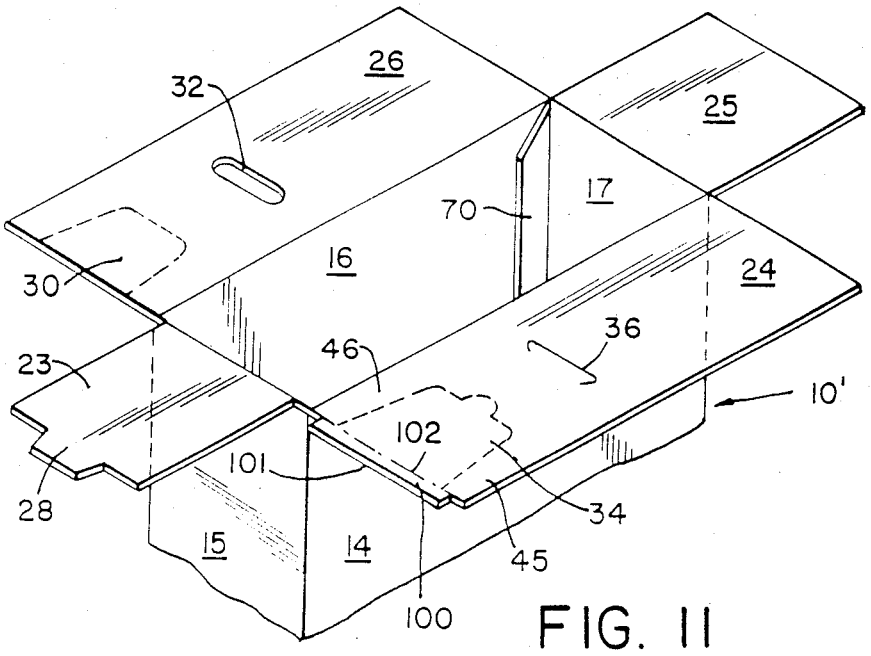
Figure 13:
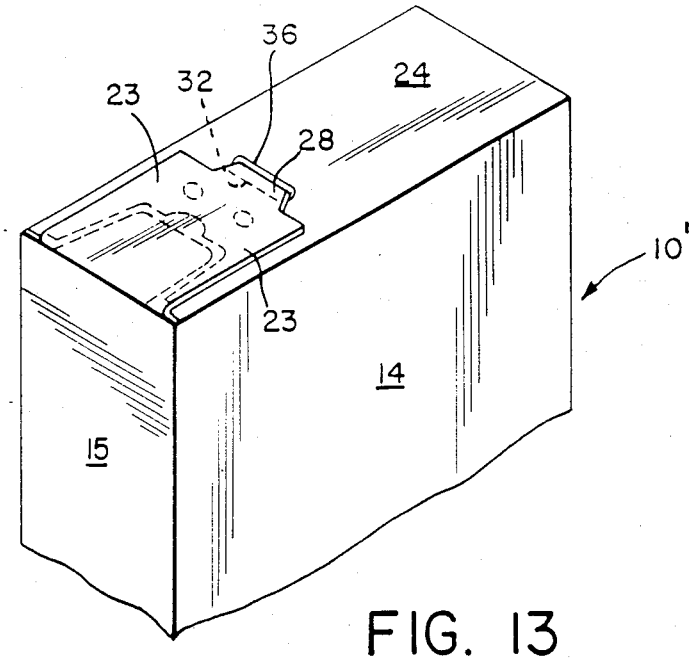
Figure 12:
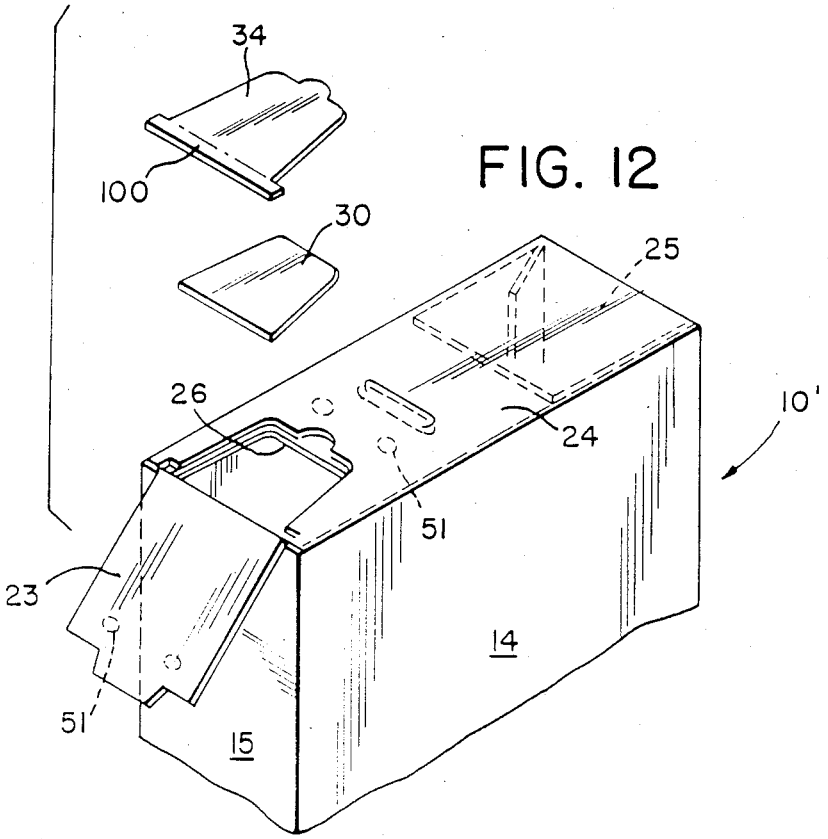

Referring now to FIGS. 10—13, therein illustrated is a second embodiment of the present invention, FIG. 10 showing the blank 60' and FIGS. 11–13 showing the carton 10 made from the blank 60'. The blank 60' and carton 10' are similar in all respects to the blank 60 and carton 10 of the first embodiment (illustrated in FIGS. 1 and 2–9, respectively), except in the following respects. The excess length 100 does not extend for the full width of inner major end panel 24, but rather extends only about half way between the edges 40*a* and 40*b* of the weakened region 34 and the adjacent edges 43, 44 of the outer major end panels 24. This results in only minor attenuation of the sift-proof feature of the present invention. Further, the line 102 connecting the excess length 100 and the weakened region 104 is a fold line adjacent the weakened region or flap 34 and a nick cut or other line of severance adjacent the unweakened regions 45, 46 of outer major end panel 24. When the carton is opened, the flap 34 and the excess length 100 are removable together as a one piece integral unit from the carton 10' (as shown in FIG. 12). As a result, when the carton is reclosed (as shown in FIG. 13), only the outer minor end panel 23 blocks the openings left by removal of the weakened regions of flaps 30 and 34.

Once a carton according to the aforementioned embodiments of the present invention is opened, the sift-proof feature is destroyed. This is of little or no concern as, once the carton is in the consumer s home, sifting is not a problem because overturning of the carton is unlikely. Accordingly, at this point, the excess length 100 is unnecessary and may either be retained on the carton or removed therefrom and discarded, as desired. Referring to FIGS. 1–9, where it is desired to retain both the flap 34 and the excess length 100 in the opened carton, the line 102 may be a foldline for its entire extent. Where it is desired instead to remove flap 34 while retaining the excess length 100, the line 102 may be nick cut between lines 40*a* and 40*b* so as to define a line of severance between the flap 34 and the excess length 100. In this instance, once the carton 10 is opened and flap 34 lifted, flap 34 is easily torn away from excess length 100 along line 102 and discarded. Referring to FIGS. 10–13, where it is desired instead to remove both flap 34 and the excess length 100, line 102 may be a foldline between lines 40*a* and 40*b*, but nick cut to define a line of severance between the excess length 100 and the unweakened regions 45, 46 on either side of the flap 34. Thus, once the flap 34 is lifted from the outer major end panel 24 during opening, the excess length 100 is attached to the carton (at unweakened regions 45, 46) only by means of nick cut portions of line 102. In this instance, once the carton 10 is opened and flap 34 lifted, the composite flap 34/excess length 100 is easily torn away from the unweakened regions 45, 46 along line 102 and discarded, for example, with flap 30.

Thus, depending upon whether the flap 34 and excess length 100 are (a) both to remain attached to the carton 10 after opening, or (b) the flap 34 is to be removed from the carton by itself, or (c) the flap 34 and the excess length 100 are to be removed together from the carton, the line 102 connecting the excess length 100 to the tab 34 and the unweakened regions 45, 46 of the outer major end panel 24 will be (a) a foldline for its entire length, or (b) a foldline adjacent the unweakened regions 45, 46 of panel 24 and a nick cut or other line of severance adjacent the flap 34, or (c) a foldline adjacent the flap 34 and a nick cut or other line of severance adjacent the unweakened regions 45, 46 of panel 24, respectively.

Referring now to FIGS. 14–16, therein illustrated is a third embodiment of the present invention in which a full width outer minor end panel 23 is employed. The carton 10" is in all respects identical to that of U.S. Pat. No. 4,718,557, especially FIG. 3 thereof, except that the weakened regions 30, 34 thereof have been removed. However, during closing and sealing of the carton 10", and more particularly after the minor end panel 25 and major end panels 24, 26 have been folded to their final orientation but before full folding of the outer minor end panel 23 (in other words, in the partially closed configuration of FIG. 6), a separate insert 120 is added to the carton 10". Insert 120 may be made of any thin, foldable, barrier-providing material such as paper, foil, glassine, plastic film or the like. Insert 120 contains on one surface 122 thereof a glue or adhesive, preferably a pressure sensitive adhesive, so that end portions 124, 126 of the surface 122, on either side of a fold 130, can be adhered to the facing surfaces of outer major end panel 24 and outer minor end panel 23 in the closed carton. Alternatively, insert 120 may be devoid of adhesive and glue can be provided on the facing surfaces of panels 23, 24. The width of insert 120 is preferably equal in width to that of the carton and, in most instances, therefore equal to the full width of the outer major end panel 24. The insert 120 may, however, be of slightly lesser width than the carton, albeit with some attenuation of the sift proof feature. The length of insert 120 is sufficient to enable one end portion 124 thereof to be secured to the outer minor end panel 23 and the other end portion 126 thereof to be secured to the outer major end panel 24, with the fold 130 between the end portions 124, 126 closing the gap between the two end panels 23, 24.

Where the major end panels 24, 26 retain the weakened regions 34, 30, or at least one of the panels 24, 26 retains its weakened region 34, 30, the end portion 126 of insert 120 need only contact the upper portion of the outer major end panel 24 and need not extend further along the length thereof to cover its weakened region 34. When the outer minor end panel 23 is lifted by the consumer and pivoted away from the outer major end panel 24, the insert 120 becomes exposed and is easily removed from the carton, thereby leaving one or more of the weakened regions 30, 34 for removal, as with the prior embodiments.

As illustrated in FIG. 14, however, the weakened regions 30, 34 are preferably removed from the blank (or at least from the carton 10" prior to application of the insert 120) and the length of end portion 126 of insert 120 is sufficient to enable it to cover the resultant openings in the major side panels 24, 26. Thus, as illustrated in FIG. 15, the insert 120 replaces both weakened regions 30, 34 and not only precludes sifting through the gap between the outer minor end panel 23 and the major end panels 24, 26, but also precludes sifting through the openings left in the major end panels 24, 26 by the removed weakened regions 30, 34. Preferably the insert 120 does not extend much beyond the weakened region 34 so as not to interfere with operation of the glued regions 51 or slit 36. The insert 120 need not be particularly strong, even if the weakened regions 30, 34 are removed, and may simply be a thin plastic film as the subsequent closure of the outer minor end panel 23 over the outer major end panel 24 affords all the necessary back-up strength to the insert 120 required to enable it to perform its function. Removal of the insert 120 by the consumer exposes the aligned openings formed by removed weakened regions 30, 34 and so enables pouring from the interior of the carton.

While the insert 120 may be completely removed from the opened carton 10'' and discarded, end portion 124 of insert 120 preferably remains attached to the outer minor end panel 23, as illustrated in FIG. 16 in phantom line, and only end portion 126 is manually lifted from the outer major end panel 24 to enable pouring. After pouring is completed, the lifted end portion 126 is returned to its original position across a portion of the outer major end panel 24, with the pressure-sensitive adhesive on surface 122 resealing with panel 24, as illustrated in FIG. 16 in solid line, thereby providing a barrier to sifting even for the reclosed carton in the consumer home. Where there is a likelihood that the particulate matter being poured from the carton interior will be adversely affected (e.g., impeded or blocked) by the loose end of the insert 120, the insert 120 may be completely removed from the carton to facilitate unimpeded pouring of the particulate matter from the carton and then after pouring, if desired, replaced on the carton in its original position in order to once again render the carton sift proof. The insert 120 may be conveniently provided, at the end portion 126 thereof contacting the outer major end panel 24, with a thin marginal end strip or corner 123 which is devoid of glue or adhesive to facilitate lifting of that end 126 (as opposed to the opposite end 124 adhered to the outer minor end panel 23).

The portion 125 of the insert 120 exposed to the contents of the carton, through the openings formed by removal of the weakened regions 30, 34, may be left devoid of glue or adhesive so that the contents of the carton do not adhere thereto and present to the consumer an impression of waste or contamination by the glue or adhesive.

Where insert 120 is secured —— e.g., by glue, adhesive or the like —— to the outer major end panel 24, it acts as an integral part thereof forming the excess length by which the length of panel 24 exceeds the length of major side panel 14 from which it extends. Preferably the insert 120 is completely covered by outer minor end panel 23 and is thus not visible prior to opening of the sealed carton.

It has been found that the combination of an opening in one end panel (as illustrated, inner major end panel 24) in combination with a slit 36 in the other end panel (as illustrated, outer major end panel 26) provides a potential path through which sifting may occur (as illustrated, first through the opening 32, and then through the slit 36). Referring now to FIGS. 17–19, in a preferred embodiment of the carton generally designated 10''', the potential sifting path may be closed by substituting for the opening 32 another slit 36'. The two slits 36, 36' are aligned along the longitudinal axis of the carton end, but with the slit 36 in the outer major end panel 24 being longitudinally disposed closer to the adjacent minor side panel 15 (that is, closer to the vertex of the outer minor end panel 23 and the minor side panel 15 from which it extends) to facilitate passage of the tab 28 of the free end of the outer minor end panel 23 passing first through the slit 36 of the outer major end panel 24 and then through the slit 36' of the inner major end panel 26, as illustrated in FIG. 19. The longitudinal displacement of the two slits 36, 36' creates a tortuous path which is not conducive to sifting.

The slit 36 on the outer major end panel 24 forms a flap 140 which must be depressed in order to allow the tab 28 of the outer minor end panel 23 to pass through the slit 36. Accordingly, it is preferred that the slit 36' of the inner major end panel 26 be slightly larger than the slit 36 of the outer major end panel 24 to facilitate displacement of the flap 140 (as well as tab 28) into the slit 36'.

It will be appreciated that this improvement in the sift-proof cartons may be utilized regardless of whether or not the cartons also incorporate excess lengths 100 or inserts 120 as the use of two longitudinally displaced slits 36, 36' is intended to close a potential sifting path other than that occurring at the vertex of the outer minor end panel 23 and its respective minor side panel 15 —— i.e., other than that to which the excess length 100 and insert 120 are directed.

Still referring to FIG. 17, it will be appreciated that the excess length may be substantially less than the width of either the carton (that is, either of the major end panels 24, 26) or the weakened regions 30, 34 and may indeed constitute simply a tab 150 having a width substantially less than the width of the weakened region 30, 34. The tab 150 does not serve a sift-free function, but rather constitutes only a means by which the weakened region 30, 34 to which it is attached may be easily and conveniently removed or pivoted away from its major end panel 26, 24, respectively. To this end, the tab 150 need only be of a sufficient size to enable it to be easily grasped and pulled by the user with sufficient strength to detach the weakened region from the carton or pivot it away. The tab 150 may conveniently be semicircular or half-moon in configuration and have a radius of about 0.25–0.50 inch (although a larger and more easily grasped tab 150 may be provided on a suitably wide carton). In this instance, the line 102 is, between the tab 150 and the weakened region 30, 34, a fold line rather than a line of severance so that the tab 150 and weakened region 30, 34 are removable from the carton together as a unit. The tab 150 will generally not extend beyond the weakened region 30, 34, but, if for a particular application the tab 150 extends beyond the weakened regions 30, 34 so as to abut the unweakened regions 45, 46 of an end panel, the line 102 between the tab 150 and unweakened regions 45, 46 would either be a cut line or a line of severance.

Preferably the tab 150 extends from the end of the weakened region 34 of the outer major end panel 24, as illustrated in FIGS. 17–19, so that the removal or pivoting of the weakened region 34 is facilitated. The weakened region 30 of the inner major end panel 26 will either have been removed during formation of the blank or may be easily pushed into or pulled out of the carton, once the outer weakened region 34 has been removed to expose the inner weakened region 30, during opening of the carton. If desired, the tab 150 may be disposed on the end of the weakened region 30 of the inner major end panel 26 so that, as the tab 150 is used to remove the inner weakened region 30, the inner weakened region 30 will carry with it the outer weakened region 34 so that all three elements —— the inner and outer weakened regions 30, 34 and tab 150 —— are removed simultaneously from the carton. Whether or not the tab 150 and inner weakened region 30 are able to carry with them the outer weakened region 34 will depend on various factors including the ease of severance of the various weakened regions 30, 34 from their respective major end panels 26, 24, the strength of the attachment of the tab 150 to the inner weakened region 30, and the like.

Just as in the embodiments using an excess length 100 the material for the excess length 100 is obtained by taking the material away from the outer minor end panel 23, thereby leaving the outer minor end panel 23 of reduced width, the tab 150 is similarly obtained at the expense of the outer minor end panel 23, thereby leaving at a .minimum a corresponding half-moon or semicircular notch 152 in the outer minor end panel 23. If desired, for aesthetic reasons, a similar notch 52 may be placed at the other side of the outer minor end panel 23, the side of the outer minor end panel 23 which would otherwise bear the notch 152 may be cut away for its full length, or both sides of the outer minor panel 23 may be cut away for their entire lengths to the depths of what would otherwise be the notch 152 in order to present a more balanced appearance. Where the tab 150 extends from the end of the weakened region 30 of the inner major end panel 26 (rather than the weakened region 34 of the outer major end panel 24), the notch 152 is formed on the opposite side of the outer major end panel 23.

The tab 150 may be used in connection with a non-sift-proof carton, a sift proof carton having an excess length 100, or a sift-proof carton having an insert 120. When used in a non sift-proof carton, the tab 150 is directly connected to the free end of the weakened region 30, 34. When used in a sift-proof carton having an excess length 100, the tab 150 is directly connected to the free end of the excess length 100 and provides a convenient means for removing the excess length 100 and weakened region 30, 34 to which it is attached by fold line 102, the tab 150 being especially useful when the excess length 100 is too short to facilitate grasping by the user. When used in a sift-proof carton having an insert 120, the tab 150 is directly connected to the free end of the weakened region 30, 34 and is disposed in the unopened carton intermediate the outer minor end panel 23 and the insert 120 and becomes exposed for grasping when the insert 120 is lifted from the outer major end panel 24 and a portion of the outer minor end panel 23 sufficiently to expose the tab 150. In most instances the natural resilience of the paperboard or like material used to form the carton will be sufficient to cause the tab 150 to project outwardly from the carton, thus facilitating grasping thereof, once the outer minor end panel 23 and any insert 120 have been pivoted away therefrom sufficiently to expose and free the entire tab 150.

The term "weakened region" as used herein refers to a region which is either connected to a panel by lines of severance so that it is easily removable from the panel or a region which has already been removed from the panel (typically during blank formation) and thus represents an opening. Thus where the excess length 100 is connected to a weakened region 30, 34, the other weakened region 34, 30 may have been removed to define an opening. Where the insert 120 is used, either one or both of the weakened regions 30, 34 may have been removed to define an opening or openings. Where the tab 150 is connected to a weakened region 30, 34 (either directly or via an excess length 100), the other weakened region 34, 30 may have been removed to define an opening.

To summarize, the present invention provides an easy opening, reclosable carton which is sift-resistant, and in a preferred embodiment substantially sift-proof, as well as a blank from which such a carton may be formed.

Now that the preferred embodiments of the present invention have been shown and described in detail, various modifications and improvements thereon will become readily apparent to those skilled in the art. Accordingly, the appended claims are to be construed broadly and in a manner consistent with the spirit and scope of the invention herein.

I claim:

1. In a carton comprising (A) sides and ends defining a rectangular parallelepiped, said sides being formed by side panels and said ends by end panels, one of the carton ends comprising first, second, and third end panels which are connected to first, second and third side panels, respectively;

(i) said first and third end panels extending from said first and third side panels, respectively, a substantial distance towards said third and first side panels, respectively, in an at least partially overlying relationship, (ii) said second end panel being pivotably connected to said second side panel and extending partially over said first and third end panels; and (B) means adhering said second end panel to the outer of said first and third end panels which permits said second end panel to be separated from said outer end panel and pivoted to expose the previously underlying portion of said outer end panel;

the improvement comprising at least one of said first and third end panels having a length in excess of the side panel from which it extends, with said excess length being at least partially compacted and folded against said outer end panel by said second end panel when said second end panel extends partially over said first and third end panels, thereby providing a sift-resistant carton.

2. The carton of claim 1 wherein said at least one end panel is said outer end panel.

3. The carton of claim 1 wherein said excess length is compacted and folded at least partially over said outer end panel.

4. The carton of claim 1 wherein said excess length is secured at its free end to said second end panel.

5. The carton of claim 1 wherein said second end panel has a width less than that of said carton by at least said excess length.

6. The carton of claim 1 wherein said second end panel has a width less than that of one of said first and third end panels.

7. The carton of claim 1 wherein said second end panel has a width less than that of said outer end panel.

8. The carton of claim 1 wherein said second end panel is spaced by at least said excess length from the vertex between said second side panel and an adjacent side panel.

9. The carton of claim 1 wherein said first end panel includes a first region which is weakened and is defined by at least on weakened portion in which that end panel is at least partially cut through, said third end panel includes a second region which is weakened and is defined by at least one weakened portion in which that end panel is at least partially cut through, said first and second regions being disposed in an overlaying relationship adjacent said second end panel, said second end panel fully overlaying at least the outer of said first and second regions in said outer end panel, said pivoting of said second end panel exposing said outer region.

10. The carton of claim 9 wherein said first or second region in the inner end panel of said first and third end panels is removed.

11. The carton of claim 9 wherein said at least one end panel is said outer end panel.

12. The carton of claim 11 wherein said first or second region in said outer end panel is secured at one end to said excess length and laterally to said outer end panel.

13. In a carton comprising (A) sides and ends defining a rectangular parallelepiped, said sides being formed by side panels and said ends by end panels, one of the carton ends comprising first, second, and third end panels which are connected to first, second and third side panels, respectively;

(i) said first and third end panels extending from said first and third side panels, respectively, a substantial distance towards said third and first side panels, respectively, in an at least partially overlying relationship, (ii) said second end panel being pivotably connected to said second side panel and extending partially over said first and third end panels; and (B) means adhering said second end panel to the outer of said first and third end panels which permits said second end panel to be separated from..said outer end panel and pivoted to expose the previously underlying portion of said outer end panel;

the improvement comprising at least one of said first and third end panels having a length in excess of the side panel from which it extends, with said excess length being at least partially compacted and folded against and over said outer end panel by said second end panel when said second end panel extends partially over said first and third end panels, and said second end panel having a width less than that of said carton by at least said excess length and being spaced by at least said excess length from the axis of intersection between said second side panel and an adjacent side panel, thereby providing a sift-resistant carton.

14. The carton of claim 13 wherein said excess length is secured at its free end to said second end panel.

15. The carton of claim 13 wherein said first end panel includes a first region which is weakened and is defined by at least one weakened portion in which that end panel is at least partially cut through, said third end panel includes a second region which is weakened and is defined by at least one weakened portion in which that end panel is at least partially cut through, said first and second regions being disposed in an overlaying relationship adjacent said second end panel, said first or second region in the inner end panel of said first and third end panels being removed, said first or second region in said outer end panel being secured at on end to said excess length and laterally to said outer end panel, said second end panel fully overlaying at least the outer of said first and second regions in said outer end panel, said pivoting of said second end panel exposing said outer region.

16. The carton of claim 13 wherein said second end panel has a width less than that of one of said first and third end panels.

17. The carton of claim 13 wherein said second end panel has a width less than that of said outer end panel.

18. In a sheet-like blank for forming a carton having side panels and end panels, the blank comprising at least four side panels and at least three end panels; first, second and third end panels being foldably connected to first, second and third side panels, respectively; each of the first, second and third end panel being defined by opposed ends and opposed sides, one of the ends of each of the first, second and third end panels being connected to a respective side panel; the first and third end panels each extending from the respective side panel a distance which is substantial compared to the width between opposed sides of the second side panel;

the improvement comprising one of said first and third end panels having a length in excess of the side panel from which it extends, with said excess length being adapted to be at least partially compacted and folded against one of said first and third end panels by said second end panel when said second end panel extends partially over said first and third end panels, thereby providing a sift-resistant carton blank.

19. The blank of claim 18 wherein said second end panel has a width less than that of the carton by at least said excess length.

20. The blank of claim 19 wherein said second end panel has a width less than that of one of said first and third end panels.

21. The blank of claim 20 wherein said second end panel has a width less than that of said outer end panel.

22. The blank of claim 18 wherein said second end panel is spaced by at least said excess length from the vertex between said second side panel and an adjacent side panel.

23. The blank of claim 18 wherein said first end panel includes a first region which is weakened and is defined by at least one weakened portion in which that end panel is at least partially cut through, said third end panel includes a second region which is weakened and is defined by at least one weakened portion in which that end panel is at least partially cut through, said first and second regions being of generally the same size and being disposed in generally corresponding locations relative to the respective first side thereof and lying within given distances from the respective first side of the respective end panel, said second end panel extending a distance from said second side panel which is greater than each of the given distances.

24. The blank of claim 23 wherein one of said first or second regions of said first and third end panels is removed.

25. The blank of claim 24 wherein the other of said first or second regions in said first and third end panels is secured at one end to said excess length and laterally to said respective end panel.

26. In a sheet like blank for forming a carton having side panels and end panels, the blank comprising at least four side panels and at least three end panels; first, second and third end panels being foldably connected to first, second and third side panels, respectively; each of the first, second and third end panels being defined by opposed ends and opposed sides, one of the ends of each of the first, second and third end panels being connected to a respective side panel; the first and third end panels each extending from the respective side panel a distance which is substantial compared to the width between opposed sides of the second side panel;

the improvement comprising one of said first and third end panels having a length in excess of the side panel from which it extends, with said excess length being adapted to be at least partially compacted and folded against and over one of said first and third end panels by said second end panel when said second end panel extends partially over said first and third end panels, and said second end panel having a width less than that of the carton by at least said excess length and being spaced by at least said excess length from the common axis of said second side panel and an adjacent side panel.

27. The blank of claim 26 wherein said second end panel has a width less than that of one of said first and third end panels.

28. The blank of claim 27 wherein said second end panel has a width less than that of said outer end panel.

29. The blank of claim 26 wherein said first end panel includes a first region which is weakened and is defined by at least one weakened portion in which that end panel is at least partially cut through, said third end panel includes a second region which is weakened and is defined by at least one weakened portion in which that end panel is at least partially cut through, said first and second regions being of generally the same size and being disposed in generally corresponding locations relative to respective first sides thereof and lying within given distances from the respective first side of the respective end panel, said second end panel extending a distance from said second side panel which is greater than each of the given distances, said first or second region in one of said first and third end panels being removed, the other of said first or second region being secured at one end to said excess length and laterally to said respective end panel, but totally cut through at the other end.

30. In a carton comprising:

(A) sides and ends defining a rectangular parallelepiped, said sides being formed by side panels and said ends by end panels, one of the carton ends comprising first, second, and third end panels which are connected to first, second and third side panels, respectively;

(i) said first and third end panels extending from said first and third side panels, respectively, a substantial distance towards said third and first side panels, respectively, in an at least partially overlying relationship.

(ii) said second end panel being pivotably connected to said second side panel, extending partially over said first and third end panels, and having a free end; and (B) means adhering said second end panel to the outer of said first and third end panels which permits said second end panel to be separated from said outer end panel and pivoted to expose the previously underlying portion of said outer end panel;

the improvement comprising at least one of said second and third end panels having a length in excess of the side panel from which it extends, with said excess length being at least partially compacted and folded against said outer end panel by said second end panel when said second end panel extends partially over said first and third end panels, thereby providing a sift-resistant carton, and said first and third end panels defining slits therethrough adapted to receive a portion of the free end of said second end panel, said slit of said outer end panel defining a tab, said slits being adjacent one another but slightly offset along the longitudinal axis of said carton end to preclude sifting through aligned slits while still enabling said tab to be partially received in said slit of the other of said end panels and said free end portion of said second end panel to be received through both of said slits.

31. In a carton comprising (A) sides and ends defining a rectangular parallelepiped, said sides being formed by side panels and said ends by end panels, one of the carton ends comprising first, second, and third end panels which are connected to first, second and third side panels, respectively;

(i) said first and third end panels extending from said first and third side panels, respectively, a substantial distance towards said third and first side panels, respectively, in an at least partially overlying relationship, said first end panel including a first region which is weakened and is defined by at least one weakened portion in which that end panel is at least partially cut through, said third end panel including a second region which is weakened and is defined by at least one weakened portion in which that end panel is at least partially cut through, said first and second regions being disposed in an overlying relationship adjacent said second end panel;

(ii) said second end panel being pivotably connected to said second side panel and extending partially over said first and third end panels; and (B) means adhering said second end panel to the outer of said first and third end panels which permits said second end panel to be separated from said outer end panel and pivoted to expose the previously underlying portion of said outer end panel, said second end panel fully overlying at least the outer of said first and second regions in said outer end panel, said pivoting of said second end panel exposing said outer region;

the improvement comprising tab means disposed at the end of one of said weakened regions for facilitating removal thereof from its end panel, said tab means being formed by one of said first and third end panels having a longitudinal portion with a length in excess of the side panel from which it extends, with said tab means being folded against said outer end panel by said second end panel when said second end panel extends partially over said first and third end panels and exposed for grasping when said second end panel is pivoted away from said first and third end panels.

32. The carton of claim 31 wherein said tab means is disposed on the weakened region cf said outer end panel.

33. The carton of claim 31 wherein said tab means has a width substantially less than that of the weakened region on which it is disposed.

34. The carton of claim 31 wherein said second end panel has a width at one point less than that of said carton by at least the length of said tab means.

35. The carton of claim 31 wherein said tab means is disposed on the end of said weakened region adjacent the vertex of said second end panel and said second side panel.

36. In a sheet-like blank for forming a carton having side panels and end panels, the blank comprising at least four side panels and at least three end panels; first, second and third end panels being foldably connected to first, second and third side panels, respectively: each of the first, second and third end panels being defined by opposed ends and opposed sides, one of the ends of each of the first, second and third end panels being connected to a respective side panel; the first and third end panels each extending from the respective side panel a distance which is substantial compared to the width between opposed sides of the second side panel, the first end panel including a first region which is weakened and is defined by at least one weakened portion in which that end panel is at least partially cut through, the third end panel including a second region which is weakened and is defined by at least one weakened portion in which that end panel is at least partially cut through, the first and second regions being of generally the same size and in the erected carton being disposed in generally corresponding locations relative to the respective first side thereof and lying within given distance from the respective first side of the respective end panel, the second end panel extending a distance from the second side panel which is greater than each of the given distances;

the improvement comprising tab means disposed at the end of one of said weakened regions for facilitating removal thereof from its end panel, said tab means being formed by on of said first and third end panels having a longitudinal portion with a length in excess of the side panel from which it extends, with said tab means being folded against one of said first and third end panels by said second end panel when said second end panel extends partially over said first and third end panels and exposed for grasping when said second end panel is pivoted away from said first and third panels.

37. The blank of claim 36 wherein said tab means has a width substantially less than that of the weakened region on which it is disposed.

38. The blank of claim 36 wherein said second end panel has a width at one point less than that of said carton by at least the length of said tab means.

39. The blank of claim 36 wherein said tab means is disposed on the end of said weakened region adjacent the vertex of said second end panel and said second side panel.

* * * * *